US005586808A

United States Patent [19]

Oelke

[11] Patent Number: 5,586,808

[45] Date of Patent: Dec. 24, 1996

[54] CHAIR WITH LATERAL FRAME PARTS CONNECTED BY TRANSVERSE RODS SUPPORTING SEAT AND BACKREST

[76] Inventor: Frank Oelke, Eichgrabenstr. 14a, D-82340 Feldafing, Germany

[21] Appl. No.: 426,040

[22] Filed: Apr. 21, 1995

[30] Foreign Application Priority Data

Apr. 22, 1994 [DE] Germany ..... 44 14 120.3
Dec. 10, 1994 [DE] Germany ..... 44 44 047.2

[51] Int. Cl.[6] ..... A47C 5/10

[52] U.S. Cl. ..... 297/287; 297/301.1; 297/285; 297/296; 297/297; 297/411.4; 297/411.41; 297/447.1; 403/131; 403/161

[58] Field of Search ..... 297/301.1, 285, 297/296, 297, 411.4, 411.41, 287, 447; 403/131, 161, 163

[56] References Cited

U.S. PATENT DOCUMENTS

| | | | |
|---|---|---|---|
| D. 146,213 | 1/1947 | Fenton | 297/287 |
| 2,454,912 | 11/1948 | Cunningham | 297/447 |
| 3,722,153 | 3/1973 | Baer | 52/81 |
| 4,049,315 | 9/1977 | Jacobson | 297/447 |
| 5,071,192 | 12/1991 | Adler | 297/464 |
| 5,195,804 | 3/1993 | Stolle et al. | 297/301.1 X |

FOREIGN PATENT DOCUMENTS

| | | | |
|---|---|---|---|
| 147973 | 8/1952 | Australia | 297/287 |
| 708933 | 7/1930 | France | 297/287 |
| 805956 | 12/1936 | France | 297/287 |
| 187071 | 10/1936 | Switzerland | 297/287 |

*Primary Examiner*—Peter M. Cuomo
*Assistant Examiner*—Stephen Vu
*Attorney, Agent, or Firm*—Robert W. Becker & Associates

[57] ABSTRACT

A chair has two lateral frame parts, each one in the form of a single, continuous member of an elastically yielding material. Transverse rods are connected between the lateral frame parts. A seat is connected to at least one of the transverse rods and a back rest is connected to at least one of the transverse rods. The single member of the lateral frame parts is preferably made of spring steel. Connecting elements that are slipped onto the lateral frame parts are used for connecting the transverse rods to the lateral frame parts. The connecting parts can be balls having throughbores for receiving the lateral frame parts and threaded holes, extending substantially perpendicularly to the throughbores, for receiving the transverse rods.

12 Claims, 4 Drawing Sheets

CHAIR WITH LATERAL FRAME PARTS CONNECTED BY TRANSVERSE RODS SUPPORTING SEAT AND BACKREST

BACKGROUND OF THE INVENTION

The present invention relates to a chair having two lateral frame parts that are connected to one another with transverse rods that support a seat and a backrest.

Such chairs are known in a plurality of different embodiments. When the lateral frame parts are comprised of metal, they are conventionally comprised of a plurality of individual members welded together or screwed together. When the chairs are comprised of wood, a plurality of wooden parts are assembled, for example, by being inserted into one another and glued together.

Chairs are known in which the frame is formed as a whole from a metal tube. This requires, due to the three dimensional shaping of the metal tube, complicated tools and limits the possibilities for embodying the seat or the backrest.

It is therefore an object of the present invention to improve a chair of the aforementioned kind such that it can be manufactured inexpensively in a simple manner.

SUMMARY OF THE INVENTION

The chair according to the present invention is primarily characterized by:

Two lateral frame parts, each one of the frame parts comprised of a single, continuous member of an elastically yielding material;

Transverse rods connected between the lateral frame parts;

A seat connected to at least one of the transverse rods; and

A backrest connected to at least one of the transverse rods.

Preferably, the single, continuous member of each one of the lateral frame parts is comprised of spring steel.

Advantageously, the chair further comprises connecting elements for connecting the transverse rods to the lateral frame parts, wherein the connecting elements are slipped onto the lateral frame parts.

Expediently, the connecting elements are balls having throughbores for receiving the lateral frame parts and further having threaded holes, extending substantially perpendicularly to the throughbores, for receiving the transverse rods.

In a preferred embodiment of the present invention the back rest is comprised of at least two elastically yielding back cushions in the form of balls connected to the at least one transverse rod, wherein the at least one transverse rod penetrates the balls.

In another embodiment of the present invention, each one of the single, continuous members of the lateral frame parts is comprised of:

A substantially vertical front leg;

An armrest;

An outwardly and upwardly bent connecting portion between the vertical front leg and the arm rest, the outwardly and upwardly bent connecting portion being bent substantially at the level of the seat;

A substantially vertical rear leg; and

An inwardly and downwardly bent connecting portion between the arm rest and the vertical rear leg.

Preferably, the armrest is shaped as a coil spring, or, in the alternative, as a meander spring.

Advantageously, the chair further comprises two lateral stays, wherein, at the level of the upper end section of the front and the rear legs, the two lateral stays and two of the transverse rods are connected with four of the connecting elements such that a rigid rectangular structure is formed, wherein each one of the four connecting elements is slipped onto a different one of the front and rear legs and receives one of the transverse rods and one of the lateral stays.

In a preferred embodiment of the present invention, the chair further comprises a coil spring for each one of the front legs wherein the coil spring extends between a lower end of the front leg and the connecting element that is slipped onto the front leg, and a coil spring for each one of the rear legs, wherein the coil spring extends between a lower end of the rear leg and the connecting element that is slipped onto the rear leg.

Preferably, a support plate, forming an abutment for the coil spring is connected to each one of the lower ends of the front and the rear legs.

Preferably, two of the connecting elements are slipped onto each one of the front and the rear legs whereby the chair further comprises a first and a second coil spring for each one of the front legs, with the first coil spring extending between a lower end of the front leg and a lower one of the connecting elements and with the second coil spring extending between the lower connecting element and an upper one of the connecting elements. Furthermore, a first and a second coil spring for each one of the rear legs are provided wherein the first coil spring extends between a lower end of the rear leg and a lower one of the connecting elements and wherein the second coil spring extends between the lower connecting element and the upper one of the connecting elements.

Advantageously, two of the connecting elements, arranged opposite one another on the lateral frame parts, are rigidly connected to one another with one of the transverse rods.

Preferably, at each one of the lateral frame parts the lower connecting element of the front leg is rigidly connected to the upper connecting element of the rear leg with one of the lateral stays.

Advantageously, the outwardly and upwardly bent connecting portion forms a displacement barrier for an adjacently positioned one of the connecting elements slipped onto the front leg and wherein the inwardly and downwardly bent connecting portion forms a displacement barrier for an adjacently positioned one of the connecting elements slipped onto the rear leg.

Preferably, the transverse rods connected between the front legs and the rear legs of the lateral frame parts form a receiving structure for the seat.

In another embodiment of the present invention each one of the single, continuous members of the lateral frame parts has an upper rearward end, a lower rearward end, and a floor-contacting portion, wherein each one of the single, continuous members is curved continuously at a first radius of curvature from the upper rear end forward and downward, then rearward and downward to the floor contacting portion, from the floor-contacting portion upward and rearward, and then with an arc of a second radius of curvature, substantially smaller than the first radius of curvature, downward and rearward to the lower rearward end, wherein the end portion of the single, continuous member, positioned between the lower rearward end and the arc, extends straight at a slant downward and rearward.

Preferably, the first radius of curvature decreases from the upper rearward end to the arc.

Advantageously, the single member is bent over more than 540° within the arc.

Expediently, the lower rearward end comprises an inwardly bent horizontal portion and the horizontal portions are rigidly connected to one another.

In a preferred embodiment of the present invention, one of the connecting elements is connected to each one of the single, continuous members at a location substantially most forward relative to the chair and to the arc, wherein every two of the connecting elements arranged opposite one another on the lateral frame parts are rigidly connected to one another with one of the transverse stays, wherein the transverse rods form a receiving structure for the seat.

Expediently, at a forward end of the single, continuous member that is closely positioned to the floor one of the connecting elements is located, the chair further comprising a coaster for each one of the single members, wherein the coaster is connected to the connecting elements.

In yet another embodiment of the present invention, the chair further comprises a roller for each one of the single members connected to the lower rearward end, wherein the rollers are positioned such that, when the chair is not in use, the floor-contacting portion is spaced from the floor.

Expediently, the chair further comprises hexagon socket head cap screws for fastening the connecting elements at the single members.

Each lateral frame part of the inventive chair is thus a substantially areal component that can be easily manufactured, and stacked for transporting. The chair can be easily assembled by connecting the frame parts with transverse rods. The elastically yielding material from which each individual lateral frame part (single, continuous member) is made can, for example, be a tube or a massive rod of any desired cross-section. It can also be comprised of fiber-reinforced plastic or metal.

Preferably, each lateral frame part is comprised of a single, continuous member of a round cross-section comprised of spring steel of, for example, 12 mm diameter. The quenching and tempering or hardening of the spring steel depends on the respective specifications that have to be met, for example, whether the lateral frame parts must be provided with holes or threads.

The connecting elements can be embodied in different ways, as is known from the prior art.

Advantageously, the connecting elements are balls that have throughbores for receiving the lateral frame parts and threaded holes for receiving the transverse rods. The threaded holes are preferably extending substantially perpendicularly to the throughbores. This embodiment ensures that the chair has no sharp edges at which clothes could be caught, and, furthermore, the chair according to this embodiment is aesthetically pleasing and elegant.

The embodiment having a backrest comprised of at least two elastically yielding back cushions in the form of balls that are connected to at least one transverse rod, with the rod penetrating the balls, is inexpensive and at the same time very comfortable. The at least two balls can be filled with air or can be filled with a foamed material. The surface of the balls can be adapted to any desired specifications.

Preferably, the single, continuous members of the lateral frame parts are comprised of a substantially vertical front leg, an armrest, an outwardly and upwardly bent connecting portion positioned between the vertical leg and the arm rest, a substantially vertical rear leg, and an inwardly and downwardly bent connecting portion positioned between the armrest and the vertical rear leg. A chair according to this embodiment is very comfortable and, when embodied as an arm chair, can be used despite its inexpensive manufacture as a stately and decorous chair.

The armrest can be shaped as a coil spring which emphasizes the highly technological appearance of the chair. When the armrest is shaped as a meander spring, a very comfortable armrest results.

By providing two lateral stays and forming a rigid rectangular structure from two longitudinal stays together with two transverse rods and four connecting elements, connected such that one of the four connecting elements is slipped onto a different one of the front and rear legs and receives one of the transverse rods and one of the lateral stays, a chair results that can be easily assembled because the lateral frame parts can be simply inserted into the connecting elements of the rigid rectangular structure.

By providing coil springs between the lower end of the front and rear legs and the connecting elements, optionally in connection with a support plate provided at the lower end of the front and rear legs, the seat is especially comfortably sprung.

When two of the connecting elements are provided at each one of the front and rear legs and when a first and a second coil spring is respectively positioned between the lower end and the first connecting element and the first and the second connecting elements at each one of the front and the rear legs, the stability of the chair is improved.

The stability of the chair can be further improved by providing that two of the connecting elements arranged opposite one another on the lateral frame parts are rigidly connected to one another with one of the transverse rods. By providing that at at least one of the lateral frame parts the lower connecting element of the front leg is rigidly connected to the upper connecting element of the rear leg with one of the lateral stays, the chair is made even more stable.

The outwardly and upwardly bent connecting portions form a displacement barrier for the adjacently positioned connecting elements slipped onto the front leg. The inwardly and downwardly bent connecting portions form a displacement barrier for the adjacently positioned connecting elements slipped onto the rear leg. With this embodiment no separate fastening means are needed for securing the connecting elements at the lateral frame parts, i.e., no additional clamping screws, hexagon socket head cap screws etc. are required.

Preferably, the transverse rods that are connected between the front and the rear legs of the lateral frame parts form a receiving structure for the seat such that the seat can be simply snapped onto the transverse rods.

According to a special embodiment of the present invention, each one of the single, continuous members of the lateral frame parts has an upper rearward end, a lower rearward end, and a floor-contacting portion. Each one of the single, continuous members is curved continuously at a first radius of curvature from the upper rearward end forward and downward, then rearward and downward toward the floor-contacting portion, from there upward and rearward, and then with an arc of a second radius of curvature, substantially smaller than the first radius of curvature, downward and rearward to the lower rearward end. An end portion of the single, continuous member located between the lower rearward end and the arc extends substantially straight downwardly and rearwardly at a slant. This special embodiment is designed after the classic rocking chair, but provides an excellent sprung comfort and is also producible inexpensively.

Preferably, the first radius of curvature decreases from the upper rearward end to the arc. The single member is preferably bent over more than 540° within the arc.

An especially simple assembly is achieved when the lower rearward end comprises an inwardly bent horizontal portion that is connected to the opposite horizontal portion of the other lateral frame part in a rigid manner.

An advantageous arrangement of the seat is accomplished when one of the connecting elements is connected to each one of the single, continuous members at a location substantially most forward relative to the chair and also to the arc, wherein two of the connecting elements, arranged opposite one another on the lateral frame parts, are rigidly connected to one another with one of the transverse rods. The thus arranged transverse rods form a receiving structure for the seat.

When at a forward end of the single, continuous member that is closely positioned to the floor one of the connecting elements is provided and a coaster is connected at each one of the single, continuous members to the aforementioned connecting elements, the chair is easily movable when tilted forwardly.

In another preferred embodiment of the present invention, rollers are provided for each one of the single, continuous members and are connected to the lower rearward end. The rollers are positioned such that, when the chair is not in use, the floor-contacting portion is spaced from the floor. This means that when the chair is not being used, it can be easily moved and rolled across the floor while when a person is sitting in the chair, i.e., the chair is in a loaded condition, the chair is substantially arrested in its position.

Preferably, hexagon socket head cap screws are used for fastening the connecting elements at the single, continuous members.

BRIEF DESCRIPTION OF THE DRAWINGS

The object and advantages of the present invention will appear more clearly from the following specification in conjunction with the accompanying drawings, in which.

Figure 1:
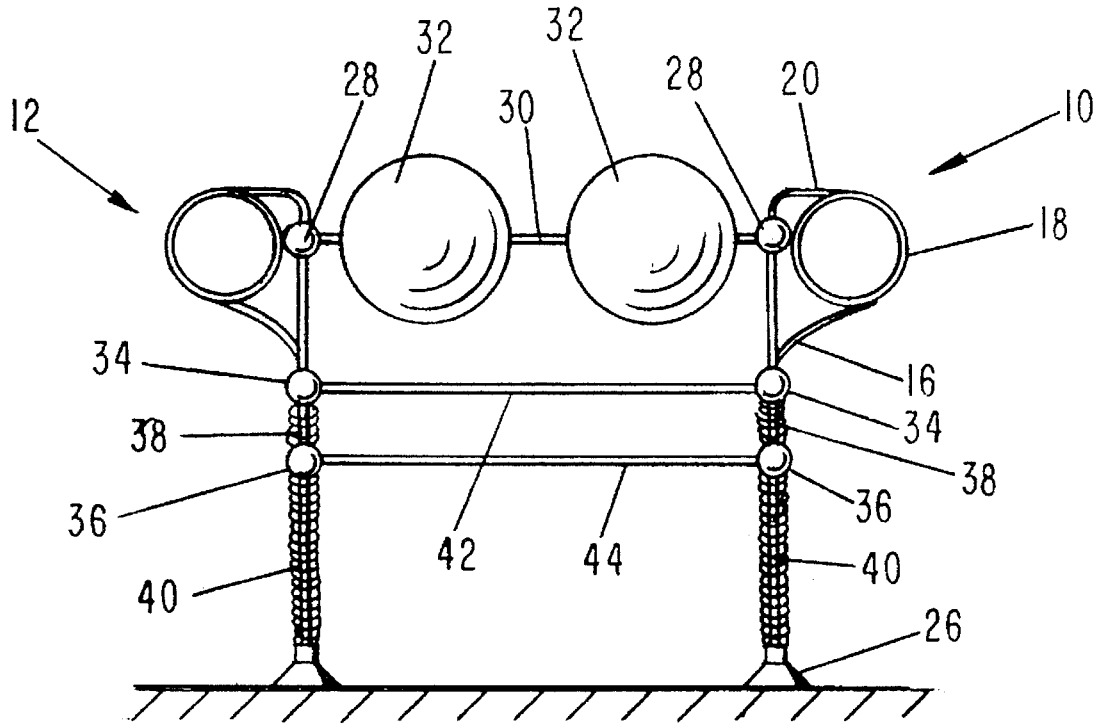
FIG. 1 shows a front view of a first embodiment of an inventive chair.
Figure 2:
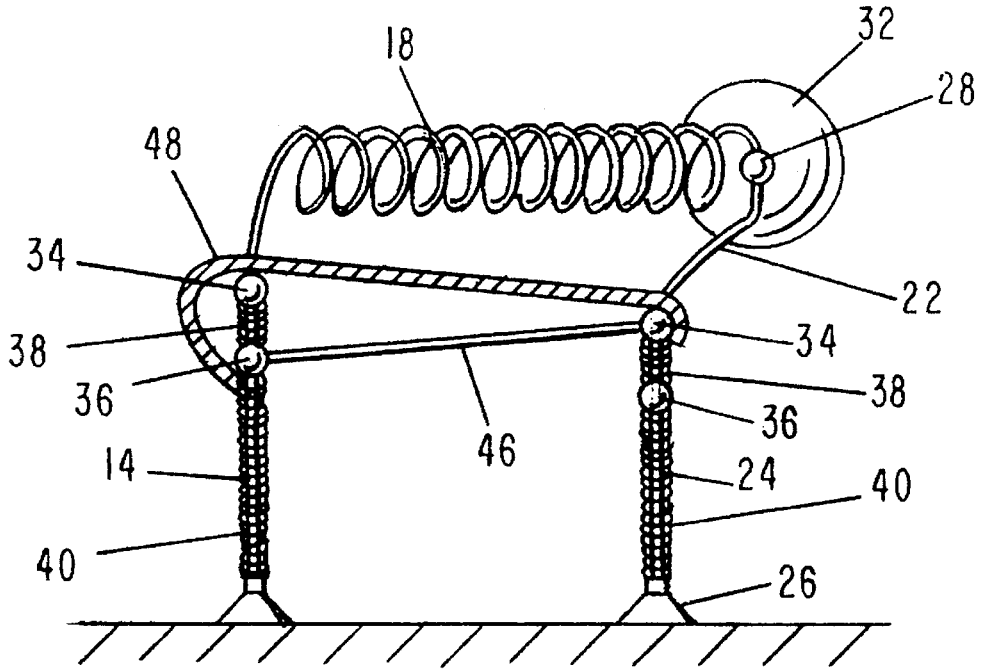
FIG. 2 shows a side view of the chair of FIG. 1.

It should be noted that in the front views of the drawing the seat, which is shown in the respective side views, is not illustrated.

DESCRIPTION OF PREFERRED EMBODIMENTS

The present invention will now be described in detail with the aid of several specific embodiments utilizing FIGS. 1 through 6.

According to FIG. 1 the inventive chair has two mirror-symmetrically designed frame parts 10 and 12. Each frame part is bent from a round profile member made of spring steel having a diameter of 12 mm. The resulting single, continous member of the frame part comprises a substantially vertically extending front leg 14 (FIG. 2) that above the level of the seat is bent outwardly to form a connecting portion 16 (FIG. 1) and has a transition into the arm rest 18, shaped as a coil spring. An inwardly and downwardly extending connecting portion 20, 22 having an inwardly oriented section 20 that continues as a downwardly oriented section 22, guided to the front, begins at the armrest 18 and ends in a substantially vertical rear leg 24. The end of each leg 14 and 24 has threaded thereto a support plate 26.

Figure 7:
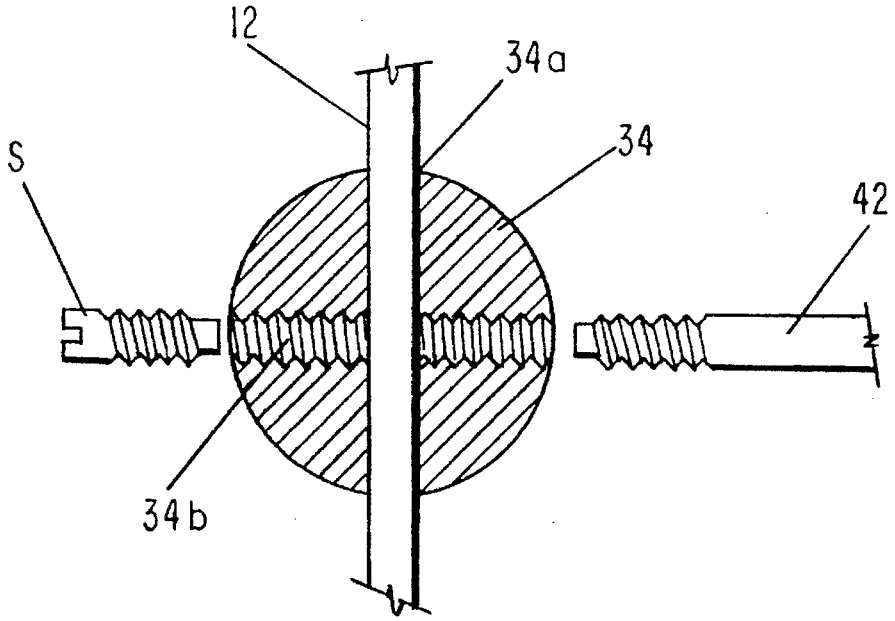
FIG. 7 shows a connecting element threaded on a single, continuous member with a transverse rod to be threaded into one threaded bore and a screw for fastening threaded into another theraded bore.

For connecting the two frame parts 10 and 12 and for achieving the required stability of the chair, the frame parts 10, 12 are provided with connecting elements in the form of balls that have throughholes and threaded bores (see FIG. 7). These balls are simply slipped onto the frame parts. Balls 28 are located at the upper part of the connecting portion 22 which extends at a slant forwardly, inwardly, and downwardly in the direction toward the rear leg 24. Each ball 28 is provided with a threaded hole for receiving a transverse rod 30 that may be in the form of a metal rod of a round cross-section and is screwed into the ball 28. The transverse rod 30 penetrates two balls 32 that are embodied so as to be yielding in order to provide a comfortable backrest at the chair. These balls 32 support softly and comfortably the lower part of the back of a person sitting in the chair.

Onto each leg 14 and 24 two balls 34 and 36 are slipped. Between the balls 34 and 36 and between the balls 36 and the support plates 26, respectively, coil springs 38 and 40 extend which surround the respective portion of the lateral frame parts. The length of the coil springs 38, 40 is selected such that the balls 34, 36 are elastically pre-stressed in the upward direction whereby the bent of the lateral frame parts above the ball 34 prevents a further upward movement when the respective throughbore is correspondingly dimensioned. Transverse rods 42 and 44 are screwed into the upper balls 34 and the lower balls 36 so that the front legs 14 and rear legs 24 are laterally spaced relative to one another. A lateral stay 46 is connected to the lower ball 36 at the front leg 14 and to the upper ball 34 provided at the rear leg 24.

The chair is assembled as follows.

Two balls 32 are slipped onto the rearward transverse rod 30. Balls 28 are then screwed to the free ends of the transverse rod 30. The thus formed component is slipped onto the rear legs 24 and secured in their end position with hexagon socket head cap screws S at the balls 28.

Two further balls 34 are screwed onto the forward upper transverse rod 42 and are slipped onto the front legs 14. Subsequently, two short coil springs 38 are slipped onto the front legs 14. A rigid rectangular structure is premounted from two lower balls 36 of the front legs 14, the corresponding transverse rod 44, the lateral stays 46, the upper balls 34 of the rear legs 24, and the corresponding transverse rod. This rectangular structure is then slipped onto the front legs 14 and the rear legs 24. Subsequently, the short coil springs 38 are slipped onto the rear legs 24. Then the balls 36 are slipped onto the rear legs 24. Now the long coil springs 38 are slipped onto the rear legs 24 and are prestressed by threading the support plates 26 to the legs 24. The chair is completed by mounting a seat 48 onto the transverse rod 42. The seat 48 is slightly slanted to the rear because the balls 34 of the forward legs 14 are at a higher level than the balls 34 of the rear legs 24.

The assembly of the chair is thus extremely simple. The seat 48 can be designed in any suitable shape, for example, as an upholstered part, as a soft perforated sheet metal piece, and, for example, can be snapped onto the transverse rods. The chair is extremely comfortable due to the areal embodiment of the armrest portions of the lateral frames in the form of coil springs 18, the seat 48 which has a large surface area, and the soft and yielding balls 32. The backrest can be designed in any other suitable form, for example, as an areal upholstered part, in the form of cubes etc.

It is to be understood that numerous deviations from the above concept are possible. For example, especially in the area of the rear legs it is sufficient to provide only one ball as a connecting element or only one transverse rod. However, in the area of the front legs two balls 34 and 36 with two transverse rods 42 and 44 are especially advantageous with respect to the stability of the chair.

Figure 8:
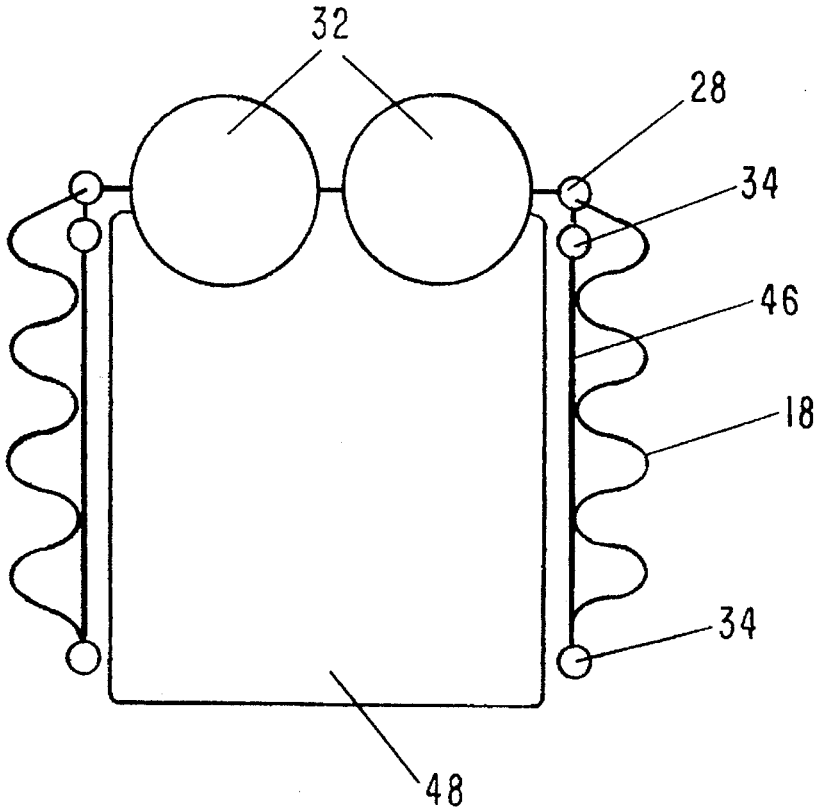
FIG. 8 shows a top view of a chair of FIGS. 1 and 2 with armrests formed as meander springs.

In the area of the armrest 18 each frame part can be shaped, instead of in the shape of a coil spring, as a meander spring (FIG. 8) whereby the meander spring extends in a horizontal plane so that an especially comfortable armrest is provided. The frame parts 10, 12, including the coil springs 38, 40, can have a metallic appearance, for example, they can be chromium-plated. The frame parts, however, can also be lacquered, for example especially in the area of the coil springs 38, 40 which imparts an interesting appearance to the chair.

Figure 3:
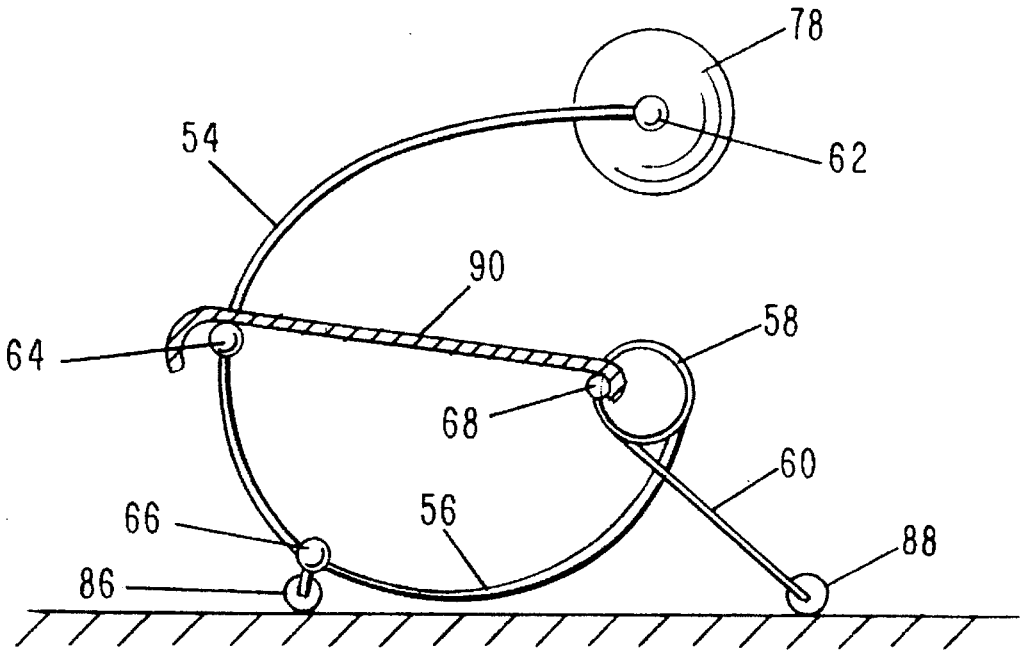
FIG. 3 shows a second embodiment of an inventive chair.
Figure 4:
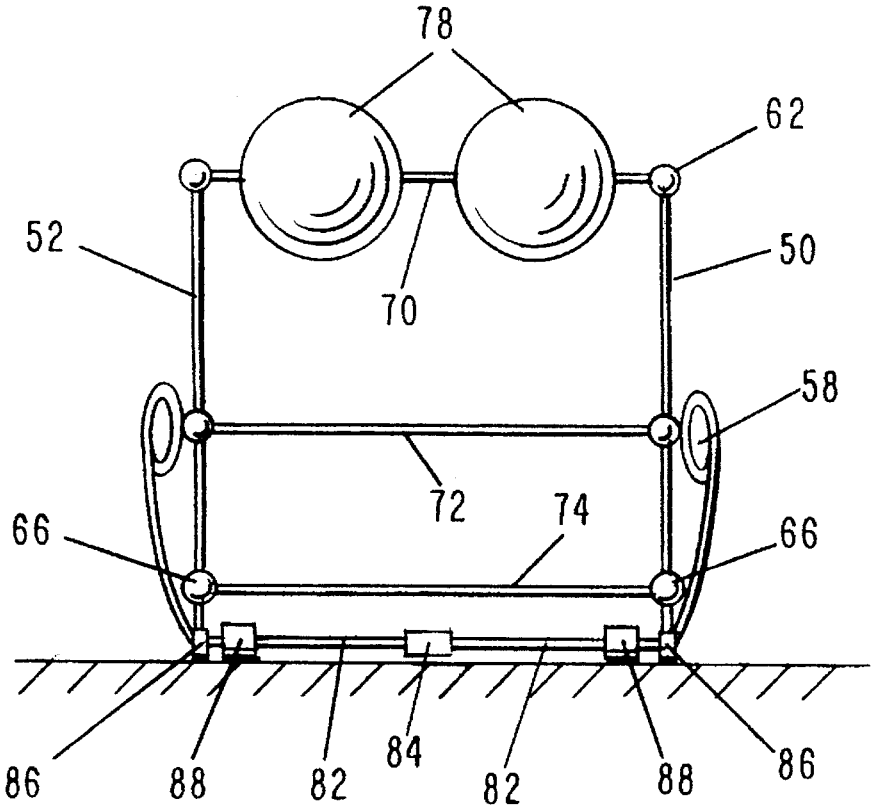
FIG. 4 shows a front view of the chair of FIG. 3.

Another extremely simple embodiment of the inventive chair is represented in FIGS. 3 and 4.

The lateral frame parts 50 and 52 are also bent from a spring steel profile member so as to be mirror-symmetrical to one another. Each frame part begins in the area of the backrest and extends in a curved portion 54 with a great radius of curvature forwardly and downwardly, then downwardly and rearwardly, and extends via a floor-contacting portion 56 to the rear and upwardly. It has a transition into an arc 58 of a small radius of curvature in which the single, continuous member is bent over more than 540° and from where it extends at a slant rearwardly and downwardly in order end in a substantially straight leg 60. The arc 58 which is essentially bent so as to correspond to a two-thread coil of a small radius of curvature provides that the leg 60 is elastically bendable relative to the remaining portion of the frame part. For transversely connecting the frame parts 50 and 52, balls are again slipped onto the frame parts, i.e., one ball 62 each is provided at the upper end, one ball 64 at the most forward area, a ball 66 shortly before the floor-contacting portion 56, and a ball 68 at the arc 58. Two oppositely arranged balls are then connected with transverse rods 70, 72, and 74 (the transverse rod connecting the ball 68 is not visible). The transverse rod 70 receives the two balls 78, corresponding to the balls of the first embodiment, in order to provide a yielding backrest.

In order to increase the stability, each leg 60 is provided with an inwardly bent end section 82. Both end sections 82 are connected to one another with a clamp 84.

The balls 66 are provided with downwardly extending coasters 86. At the bent end sections a roller 88 is provided, respectively. The coasters 86 and rollers 88 cooperate with the frame parts 50 and 52 such that when the chair is not in use the floor-contacting portion 56 is spaced at a small distance from the floor so that the chair can be easily moved by means of the coasters 86 and rollers 88 a desired location. When a person is seated on the chair, the legs 60 are elastically bent such that the floor-contacting portion 56 comes into contact with the floor so that the chair is arrested in its position.

When no rollers 88 are provided, the chair can be easily moved by tilting the chair forwardly and loading the coasters 86.

The assembly of the chair can be carried out similarly to the first embodiment such that two oppositely arranged balls are connected to one another by screwing the corresponding transverse rod therein and by sliding the balls with corresponding transverse rods onto the frame parts from the free end of the frame parts at the backrest. For fastening the balls at the desired location, the balls are provided with non-represented hexagon socket head cap screws.

The transverse rods which connect the balls 64 and 68 provide a receiving structure for the seat 90. This second embodiment of the chair is also extremely inexpensive in its manufacture. It is very comfortable and decorative. Furthermore, the chair is very light-weight.

Figure 5:
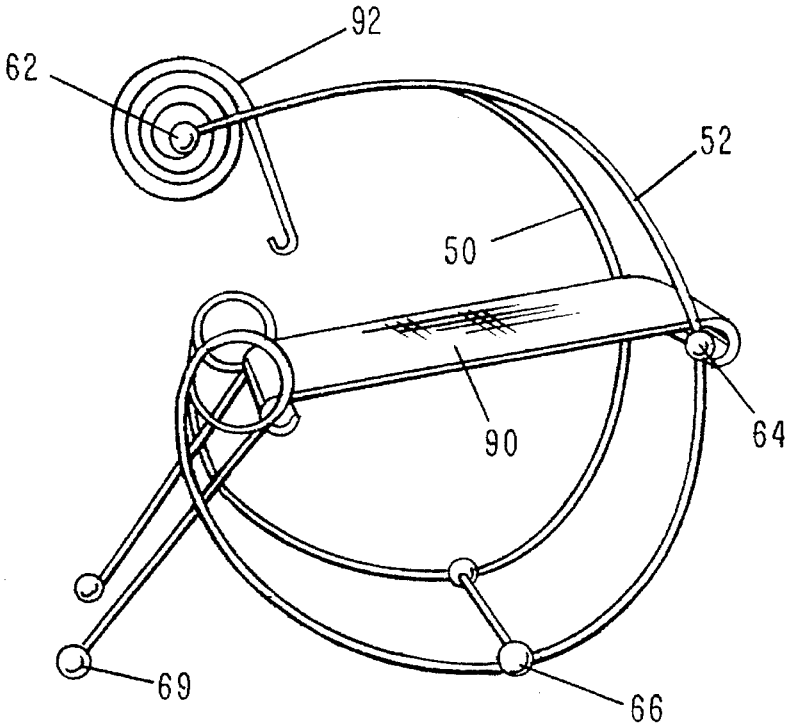
FIGS. 5 and 6 show perspective views of a slightly altered embodiment of the chair of FIGS. 3 and 4.
Figure 6:
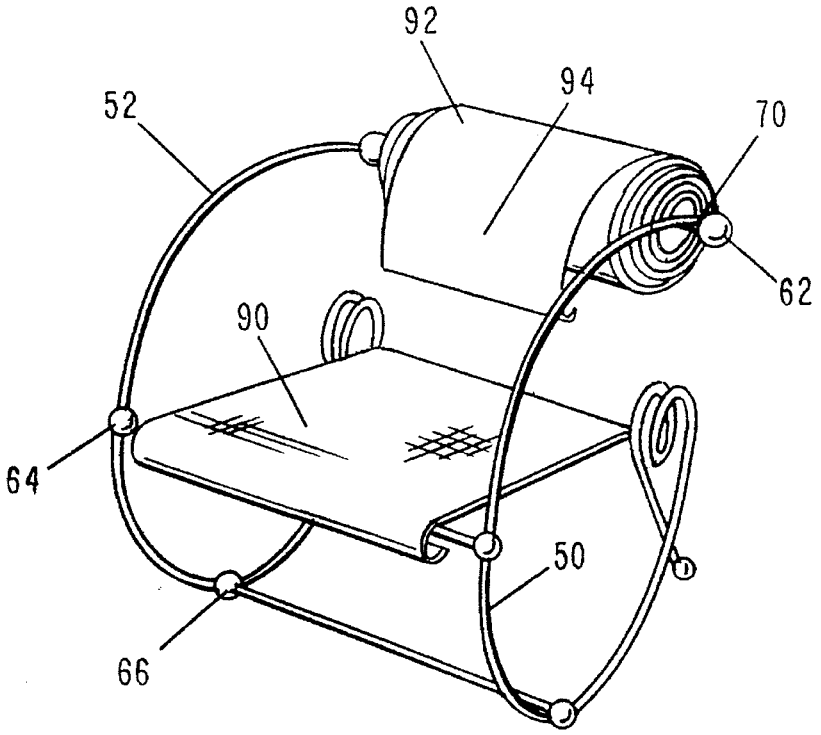

For this embodiment numerous deviations from the shown specific embodiment are also possible. For example, the coasters 86 as well as the rollers 88 can be omitted and the legs 60 can end in balls 69 (FIG. 5) that are screwed onto the ends of the legs 60 and similar to the balls 62, 64, 66 or 68. The seat 90 can be upholstered or can be comprised of a yielding, thin sheet steel with formed seat portion whereby the sheet steel can be laminated or perforated. The backrest 92, as is shown in FIGS. 5 and 6, can also be formed by a component that is wound in the form of a spiral from thin sheet steel. The spiral is welded to the transverse rod 70, fixed by the balls 62 to the frame parts, so as to be non-rotational. The spiral advantageously tapers in the direction to the free end 94 which supports the back of a person sitting in the chair.

In this manner, the entire chair can be made from steel. This imparts a long service life and also an excellent spring behavior as well as a pleasing aesthetic appearance.

The present invention is, of course, in no way restricted to the specific disclosure of the specification and drawings, but also encompasses any modifications within the scope of the appended claims.

What is claimed is:

1. A chair comprising:

two lateral frame parts, each one of said frame parts comprised of a single, continuous member of an elastically yielding material;

transverse rods connected between said lateral frame parts;

a seat connected to at least one of said transverse rods; and a backrest connected to at least one of said transverse rods; and wherein each one of said single members of said lateral frame parts has an upper rearward end, a lower rearward end, and a floor-contacting portion, wherein each one of said single members is curved continuously at a first radius of curvature from said upper rearward end forward and downward, then rearward and downward to said floor-contacting portion, from said floor-contacting portion upward and rearward, and then with an arc of a second radius of curvature, substantially smaller than said first radius of curvature, downward and rearward to said lower rearward end, wherein an end portion of said single member, positioned between said lower rearward end and said arc, extends straight downward and rearward at a slant.

2. A chair according to claim 1, wherein said single member of each one of said lateral frame parts is comprised of spring steel.

3. A chair according to claim 1, further comprising connecting elements for connecting said transverse rods to said lateral frame parts, wherein said connecting elements are slipped onto said lateral frame parts.

4. A chair according to claim 3, wherein said connecting elements are balls having throughbores for receiving said lateral frame parts and further having threaded holes, extending substantially perpendicularly to said throughbores, for receiving said transverse rods.

5. A chair according to claim 1, wherein said backrest is comprised of at least two elastically yielding back cushions in the form of balls connected to said at least one transverse rod, wherein said at least one transverse rod penetrates said balls.

6. A chair according to claim 1, wherein said first radius of curvature decreases from said upper rearward end to said arc.

7. A chair according to claim 1, wherein said single member is bent over more than 540° within said arc.

8. A chair according to claim 1, wherein each one of said lower rearward ends comprises an inwardly bent horizontal portion and wherein said horizontal portions are rigidly connected to one another.

9. A chair according to claim 1, wherein one of said connecting elements is connected to each one of said single members at a location substantially most forward relative to said chair and to said arc, wherein every two of said connecting elements arranged opposite one another on said lateral frame parts are rigidly connected to one another with one of said transverse rods, and wherein said transverse rods form a receiving structure for said seat.

10. A chair according to claim 9, wherein at a forward end of said single, continuous member that is closely positioned to the floor one of said connecting elements is located, further comprising a coaster for each one of said single members, said coaster connected to said connecting elements.

11. A chair according to claim 10, further comprising a roller for each one of said single members connected to said lower rearward end, wherein said rollers are positioned such that, when said chair is not in use, said floor-contacting portion is spaced from the floor.

12. A chair according to claim 1, further comprising hexagon socket head cap screws for fastening said connecting elements at said single members.

* * * * *